United States Patent [19]

Vanhove

[11] 4,272,859

[45] Jun. 16, 1981

[54] METHOD FOR MANUFACTURING OVERSHOES MADE OF NON-WOVEN FABRIC

[75] Inventor: Jacques Vanhove, Romilly sur Seine, France

[73] Assignee: Mutexil, France

[21] Appl. No.: 92,083

[22] Filed: Nov. 7, 1979

[30] Foreign Application Priority Data

Nov. 20, 1978 [FR] France ..... 78 32636

[51] Int. Cl.[3] ..... A43D 9/00; A43B 3/16

[52] U.S. Cl. ..... 12/142 K; 36/7.1 R

[58] Field of Search ..... 12/142 R, 142 E, 142 EV, 12/142 K; 36/7.1, 7.3, 1, 224; 361/223

[56] References Cited

U.S. PATENT DOCUMENTS

| | | | |
|---|---|---|---|
| 3,283,422 | 11/1966 | Nygard | 36/1 |
| 3,337,770 | 8/1967 | Saracehi et al. | 36/7.1 R |
| 3,402,323 | 9/1968 | Longstreth | 36/7.1 R |
| 3,422,550 | 1/1969 | Robinson | 36/7.1 R |
| 3,737,723 | 6/1973 | Kanor | 36/7.3 |

*Primary Examiner*—Patrick D. Lawson

*Attorney, Agent, or Firm*—Merriam, Marshall & Bicknell

[57] ABSTRACT

The present invention relates to a method for making an overshoe made of non-woven fabric, wherein a blank is used, constituted by two identical sheets in the form of a parallelogram and connected along one of their large sides by a gusset adapted to form the sole and along their small sides by lines of join, also joining the opposite faces of said gusset. The invention is more particularly applicable to the manufacture of disposable overshoes.

6 Claims, 4 Drawing Figures

METHOD FOR MANUFACTURING OVERSHOES MADE OF NON-WOVEN FABRIC

Method for manufacturing overshoes made of non-woven fabric.

The present invention relates to shoes, or overshoes, adapted to be fitted over shoes and to be discarded after a limited number of uses. Such overshoes are generally intended for persons entering premises where there are risks of microbial or radioactive contamination.

These overshoes must be strong in order to resist wear and tear, but they must also be of low cost price as they are disposable. This is why they are generally provided in non-woven fabric. However, the known methods for manufacturing such overshoes remain complicated and expensive.

It is an object of the present invention to remedy this drawback and to enable such overshoes to be manufactured simply and inexpensively.

To this end, the method for making an overshoe made of non-woven fabric is noteworthy, according to the invention, in that a blank is used which is constituted by two identical sheets in the form of a parallelogram and connected along one of their large sides by a gusset adapted to form the sole and along their small sides by lines of join, also joining the opposite faces of said gusset.

The overshoe is made up from such a blank by forming the toe by folding, tucking, etc . . . by gluing, welding or stitching along folds, and by placing a gathered elastic around the opening defined by the large sides opposite the gusset.

To obtain a blank as specified hereinabove, a tube of non-woven fabric is advantageously used, comprising two flat longitudinal faces connected to each other by two lateral gussets and repetitive transverse lines of join are made in said tube which are oblique with respect to the axis of the tube to define between each pair of consecutive lines a diamond or a double-walled parallelogram, after which said diamonds or double-walled parallelograms are separated from one another at the level of said lines of join, whilst each of them is cut into two along a median longitudinal line of cut.

In this way, two blanks are obtained in each of said diamonds or parallelograms.

The lines of join may be made by stitching, gluing or welding.

To obtain the elastic gathering of the opening of the overshoes, stretched elastic is advantageously fixed on the tube, before it is cut up, on each side of said tube and on either side of the median longitudinal line of cut.

The tube of non-woven fabric is preferably obtained by shaping and folding a strip of this material, joined along its free longitudinal edges.

All these operations may be carried out on an automatic machine, this enabling the production costs to be reduced.

The invention will be more readily understood on reading the following description with reference to the accompanying drawings, in which.

Figure 1:
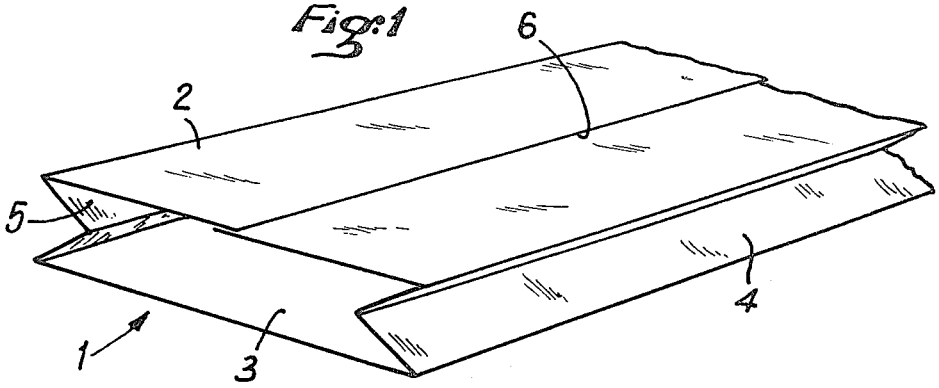
FIG. 1 shows, in perspective, a tubular element from which the overshoes according to the invention are made.
Figure 2:
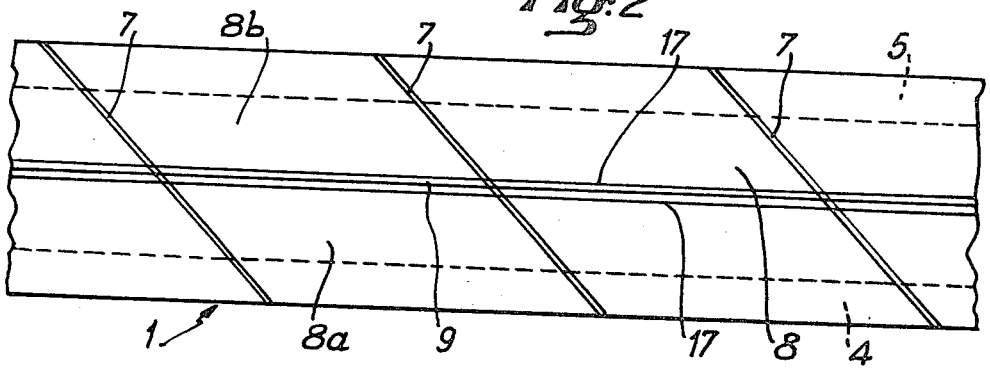
FIG. 2 illustrates the method for the mass production of overshoes according to the invention from the tubular element of FIG. 1.

To mass-produce overshoes according to the invention, a continuous strip of a non-woven fabric is folded on an automatic machine to obtain a tube 1, having two flat parallel faces 2 and 3, connected together by lateral gussets 4 and 5 (cf. FIG. 1). The cross section of the tube 1 is substantially identical to that of known packaging bags with gussets. The side edges of the continuous strip are joined to each other, for example by welding, along a longitudinal line 6.

The tube 1 advances flat beneath a welding apparatus adapted to make repetitive, transverse and oblique lines of weld, gluing or stitching 7 in said tube, said lines defining in the tube diamonds or parallelograms 8. The lines 7 join not only faces 2 and 3 to each other, but also the faces of the gusset 4 and those of gusset 5 together.

After the lines of join 7 have been made, the diamonds or parallelograms 8 are separated from one another by lines of cut disposed inside said lines 7, whilst the tube 1 is cut longitudinally into two, along a longitudinal line of cut 9.

Thus, in each diamond or parallelogram 8, a parallelogram **8*a* and a parallelogram 8*b* are obtained, composed of two portions of the superposed sheets 2 and 3, connected by a portion of gusset 4 for parallelograms 8*a*, and by a portion of gusset 5 for parallelograms 8*b***.

Figure 3:
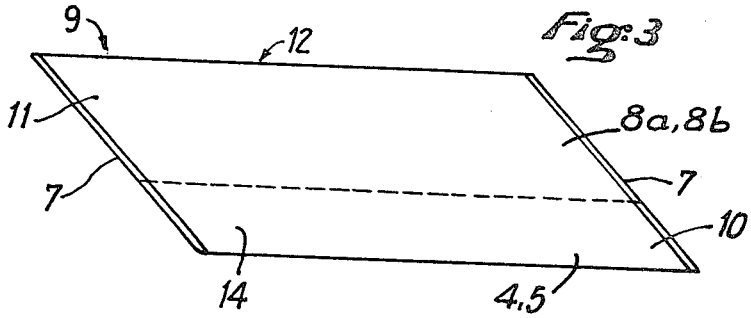
FIG. 3 illustrates a frontal view of an overshoe blank according to the invention.

Each diamond or parallelogram 8 therefore gives a pair of blanks **8*a* or 8*b* each adapted to form an overshoe, of which the sole is formed by the corresponding portion of gusset 4 or 5. FIG. 3 shows such a blank 8*a* and 8*b***.

Figure 4:
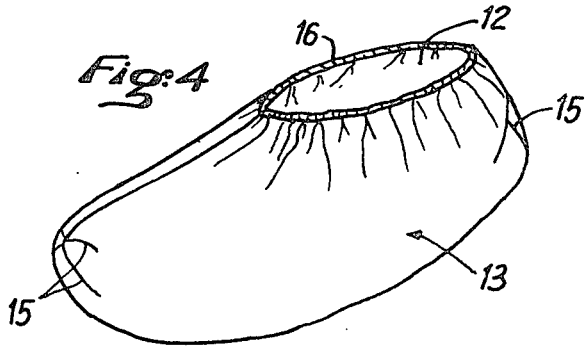
FIG. 4 shows in perspective an overshoe obtained from the blank of FIG. 3.

In this blank, the acute-angle 10 on gusset 4 or 5 side is intended to form the front of the foot, whilst the acute-angle 11 on the side of the opening 12 defined by the line of cut 9, is intended to form the rear of the foot. The overshoe 13 (FIG. 4) is then made from a blank **8*a* or 8*b* by shaping the acute-angle 10 and the opposite obtuse angle 14, on the gusset 4, 5 side, for example by tucking them in said overshoe and fixing them by means of lines of gluing or welding 15**.

At least one elastic 16 is arranged around the opening 12 of the overshoe so that this opening is tightened against the wearer's ankle.

The elastic 16 may be fixed on the opening 12 after the blanks **8*a*, 8*b* or the overshoes 13 have been cut out and shaped. However, it is advantageous if the elastic is placed in position before cut-outs are made along the inclined lines 7 and the longitudinal line 9**.

To this end, on each side of the tube 1, stretched elastic 17 may be glued on either side of the line of cut 9, parallel thereto. In this way the opening 12 will be gathered by the slackened elastic 17, after cut-out.

I claim:

1. A method for forming a blank of non-woven fabric suitable for making an overshoe, comprising the steps of:

forming a tube of non-woven fabric, said tube comprising two flat longitudinal faces connected to each other by two lateral gussets each of which is adapted to form the sole of an overshoe, forming a plurality of spaced transverse lines of join in said tube, said lines of join being oblique with respect to the axis of said tube and joining said longitudinal faces and the opposite faces of said gussets, consecutive lines of join defining a diamond or double-walled parallelogram, separating said diamonds or double-walled parallelograms along said lines of join, and cutting each of said diamonds along a median longitudinal line of cut to obtain two blanks having an opening created by said line of cut.

2. A method as claimed in claim 1, wherein, to obtain an elastic gathering of the opening of the overshoes, stretched elastic is fixed on the tube, before it is cut up, on each side of said tube and on either side of the median longitudinal line of cut.

3. A method as claimed in either one of claims 1 or 2, wherein said tube is obtained by shaping and folding a strip of which the free edges are joined to each other.

4. A method as claimed in claim 1, wherein its different steps are carried out on an automatic machine.

5. A blank for making an overshoe made of non-woven fabric, obtained by carrying out the method as claimed in claim 1.

6. An overshoe, obtained from the blank as claimed in claim 6.

* * * * *

UNITED STATES PATENT AND TRADEMARK OFFICE

CERTIFICATE OF CORRECTION

PATENT NO. : 4,272,859

DATED : June 16, 1981

INVENTOR(S) : JACQUES VANHOVE

It is certified that error appears in the above-identified patent and that said Letters Patent are hereby corrected as shown below:

Col. 4, line 12 (claim 6), "claim 6" should read --claim 5--.

Signed and Sealed this

*Twenty-second* Day of *September 1981*

[SEAL]

*Attest:*

GERALD J. MOSSINGHOFF

*Attesting Officer*

*Commissioner of Patents and Trademarks*